US008152233B2

(12) United States Patent
Wechter

(10) Patent No.: US 8,152,233 B2
(45) Date of Patent: Apr. 10, 2012

(54) ADAPTATION TO AN ASSISTIVE DEVICE

(76) Inventor: Brian J. Wechter, Canton, GA (US)

( * ) Notice: Subject to any disclaimer, the term of this patent is extended or adjusted under 35 U.S.C. 154(b) by 0 days.

(21) Appl. No.: 11/750,104

(22) Filed: May 17, 2007

(65) Prior Publication Data

US 2007/0273181 A1 Nov. 29, 2007

Related U.S. Application Data

(60) Provisional application No. 60/747,621, filed on May 18, 2006.

(51) Int. Cl.

| | |
|---|---|
| ***A47C 1/00*** | (2006.01) |
| ***A47C 13/00*** | (2006.01) |
| ***A47C 15/00*** | (2006.01) |
| ***A47B 1/04*** | (2006.01) |
| ***A47B 85/00*** | (2006.01) |
| ***A47B 85/04*** | (2006.01) |

(52) U.S. Cl. ..... 297/124; 297/107; 297/108; 297/109; 297/119; 297/233; 297/248; 4/560.1; 4/573.1; 4/578.1; 4/579; 108/69

(58) Field of Classification Search ..... 297/119, 297/124, 129, 344.18, 354.13, 107, 108, 297/109, 233, 248; 108/69, 71; 4/578.1, 4/560.1, 571.1, 573.1, 579, 604
See application file for complete search history.

(56) References Cited

U.S. PATENT DOCUMENTS

| | | | | | |
|---|---|---|---|---|---|
| 33,192 | A | * | 9/1861 | Gurley et al. | 297/109 |
| 80,322 | A | * | 7/1868 | Williams | 297/107 |
| 126,266 | A | * | 4/1872 | Coates | 297/109 |
| 134,875 | A | * | 1/1873 | Fauh | 297/109 |
| 153,665 | A | * | 8/1874 | Coates | 297/109 |
| 164,370 | A | * | 6/1875 | Ham | 297/110 |
| 173,071 | A | * | 2/1876 | Sheldon | 297/108 X |
| 189,964 | A | * | 4/1877 | Stevens et al. | 297/108 |
| 203,605 | A | * | 5/1878 | Eastman | 297/108 |
| 212,778 | A | * | 2/1879 | Woolverton | 297/233 X |
| 259,953 | A | * | 6/1882 | Welsh et al. | 297/108 X |
| 262,901 | A | * | 8/1882 | Kulich | 297/108 X |
| 863,874 | A | * | 8/1907 | Rajner | 297/248 X |
| 885,234 | A | * | 4/1908 | Eriksson | 297/108 |
| 1,024,944 | A | * | 4/1912 | McCaffrey | 297/108 |
| 1,061,533 | A | * | 5/1913 | Englander | 297/108 X |

(Continued)

FOREIGN PATENT DOCUMENTS

DE 298 00 454 U1 5/1998

(Continued)

*Primary Examiner* — Rodney B White
*Assistant Examiner* — Philip S. Kwon
(74) *Attorney, Agent, or Firm* — Jon Fallon, Esq.

(57) ABSTRACT

A transfer bench and methods for using same to facilitate movement of a person into and out of an enclosure are disclosed. The transfer bench comprises a first seating section that at least partially lies in a horizontal plane. A second seating section rotatably coupled to the first seating section is configured to rotate between a generally horizontal position and a generally vertical position. Each seating section can be supported by one or more legs. The transfer bench can be positioned in the enclosure. A user sits on the second seating section, moves to the first seating section, and can rotate the second seating section to a vertical position such that the transfer bench is disposed within the enclosure. The enclosure may be a wet/dry environment and can be enclosed by means such as a shower curtain, door, or other enclosure means.

18 Claims, 5 Drawing Sheets

U.S. PATENT DOCUMENTS 1,335,973 A * 4/1920 Kesselman ..... 297/107
1,347,417 A * 7/1920 Sturk ..... 297/106 X
1,369,543 A 2/1921 Reider
1,421,929 A * 7/1922 Floreskul ..... 297/124 X
1,597,922 A * 8/1926 Osborn ..... 4/579 X
2,173,993 A * 9/1939 Amdur ..... 4/558
2,237,076 A 4/1941 Kenney et al.
2,965,153 A * 12/1960 Purcell, Sr. ..... 4/578.1 X
3,596,981 A * 8/1971 Koziol ..... 297/233 X
3,855,646 A * 12/1974 Glickman ..... 4/578.1
4,166,297 A 9/1979 Saleeby
4,446,796 A * 5/1984 Wilson et al. ..... 108/69
4,472,844 A * 9/1984 Mace ..... 4/579
4,508,384 A * 4/1985 Castelot et al. ..... 297/108 X
4,750,432 A * 6/1988 McNamara et al. ..... 108/69
5,251,956 A * 10/1993 Hofmeyer ..... 297/173
5,335,377 A * 8/1994 Masyada et al. ..... 4/578.1
5,341,525 A * 8/1994 Tillman et al. ..... 4/579
5,342,114 A * 8/1994 Burke et al. ..... 297/344.2
5,361,428 A 11/1994 Nanowsky et al.
5,403,082 A * 4/1995 Kramer ..... 312/249.9
5,517,704 A * 5/1996 Dagostino ..... 4/560.1
5,647,632 A * 7/1997 Fireman ..... 297/109
5,790,997 A * 8/1998 Ruehl ..... 5/618
5,865,505 A * 2/1999 Eley ..... 297/354.13
5,940,905 A * 8/1999 Cheng ..... 4/578.1
5,971,485 A * 10/1999 Clark ..... 297/423.12
6,039,403 A 3/2000 Hargroder
6,105,183 A 8/2000 Bly
6,182,304 B1 * 2/2001 Freeberg ..... 4/560.1
6,256,806 B1 * 7/2001 DiTommaso ..... 4/560.1
6,279,178 B1 * 8/2001 Hill ..... 4/578.1
6,520,093 B1 * 2/2003 Merl ..... 108/69
6,547,330 B1 * 4/2003 Hester ..... 297/322
6,773,059 B2 * 8/2004 Volotsenko ..... 297/129
6,792,633 B1 * 9/2004 Ito ..... 5/618
6,805,406 B1 * 10/2004 Jansen ..... 297/328
6,842,919 B2 * 1/2005 Wilson et al. ..... 4/578.1
6,886,194 B2 * 5/2005 Hodgetts ..... 5/86.1
6,899,392 B1 * 5/2005 Saberan et al. ..... 297/334
7,025,420 B2 * 4/2006 Guinea Pena et al. ... 297/354.13
7,114,770 B2 * 10/2006 Murphy ..... 297/85
7,182,404 B2 * 2/2007 Laurent ..... 297/411.39
7,451,501 B2 * 11/2008 Cheng ..... 4/578.1
7,661,154 B2 * 2/2010 Cheng ..... 4/560.1
7,980,584 B2 * 7/2011 Goldstein ..... 4/560.1 X
2004/0051365 A1 * 3/2004 Darst et al. ..... 297/440.1
2004/0080201 A1 * 4/2004 Verny et al. ..... 297/354.13
2005/0127721 A1 * 6/2005 Kong ..... 297/119
2006/0260041 A1 * 11/2006 Paz ..... 4/573.1
2008/0092288 A1 * 4/2008 Cheng ..... 4/578.1

FOREIGN PATENT DOCUMENTS

WO WO/01/70088 9/2001

* cited by examiner

ADAPTATION TO AN ASSISTIVE DEVICE

CROSS-REFERENCE TO RELATED APPLICATION

This application claims the benefit of U.S. Provisional Application Ser. No. 60/747,621 filed May 18, 2006, the entire contents of which are hereby incorporated by reference.

FIELD OF THE INVENTION

This invention relates generally to transfer benches and, more particularly, to a transfer bench adapted to facilitate the movement into and out of an enclosure, such as a bathtub, by persons having limited mobility.

BACKGROUND OF THE INVENTION

Movement into and out of a wet environment, such as a bathtub, can be difficult for persons having limited mobility. Such movement, for a person with a standard level of mobility, normally requires a minimal amount of effort and care to maintain safety. However, for persons with limited mobility such as invalids, handicapped, disabled, or other persons with conditions that limit the functionality of muscles, the minimal amount of effort and care often precludes the safe use of a bathtub or other wet environment.

Currently known devices that may assist a person upon entry or exit of a wet environment do not adequately protect the safety of the person. For example, the devices may not allow for enclosure of the wet environment, such as by a door or curtain, and thus allow for water to spill beyond the periphery of the wet environment. This can further compromise the safety of the individual.

Thus, there is a need in the art for a device and methods of using same that facilitates the movement into and out of a wet environment while maximizing safety to an individual.

SUMMARY OF THE INVENTION

In accordance with the purposes of this invention, as embodied and broadly described herein, this invention, in one aspect, relates to a transfer bench for use in an enclosure. The transfer bench can comprise a first seating section, a portion of which lies substantially in a horizontal plane. The transfer bench can also comprise a second seating section coupled to the first seating section and configured to rotate from and between a first and second position, such as a generally horizontal and generally vertical position, respectively. The second seating section can extend beyond a periphery of the enclosure when in the first position. One or more legs can also be provided to support each of the first and second seating sections.

Methods are also disclosed for facilitating movement of a person into and out of an enclosure, such as by using a transfer bench. A transfer bench can be positioned within the enclosure such that the first seating section is fully disposed within the periphery of the enclosure. When in the first position, the second seating section can extend beyond the periphery. When the second seating section is in the second position, the transfer bench can be substantially disposed within the enclosure such that enclosure means can be manipulated to partially or substantially enclose the enclosure.

Additional advantages of the invention will be set forth in part in the description which follows, and in part will be obvious from the description, or may be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several aspects of the invention and together with the description, serve to explain the principles of the invention.

DESCRIPTION OF THE PREFERRED EMBODIMENTS

The present invention may be understood more readily by reference to the following detailed description, examples, drawings, and claims, and their previous and following description. However, before the present devices, systems, and/or methods are disclosed and described, it is to be understood that this invention is not limited to the specific devices, systems, and/or methods disclosed unless otherwise specified, as such can, of course, vary. It is also to be understood that the terminology used herein is for the purpose of describing particular aspects only and is not intended to be limiting.

As used in the specification and the appended claims, the singular forms "a," "an" and "the" include plural referents unless the context clearly dictates otherwise. Thus, for example, reference to a "leg" can include two or more such legs unless the context indicates otherwise.

Ranges may be expressed herein as from "about" one particular value, and/or to "about" another particular value. When such a range is expressed, another embodiment includes from the one particular value and/or to the other particular value. Similarly, when values are expressed as approximations, by use of the antecedent "about," it will be understood that the particular value forms another embodiment. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

Reference will now be made in detail to the present preferred aspects of the invention, examples of which are illustrated in the accompanying drawings. Wherever possible, the same reference numbers are used throughout the drawings to refer to the same or like parts.

Figure 3:
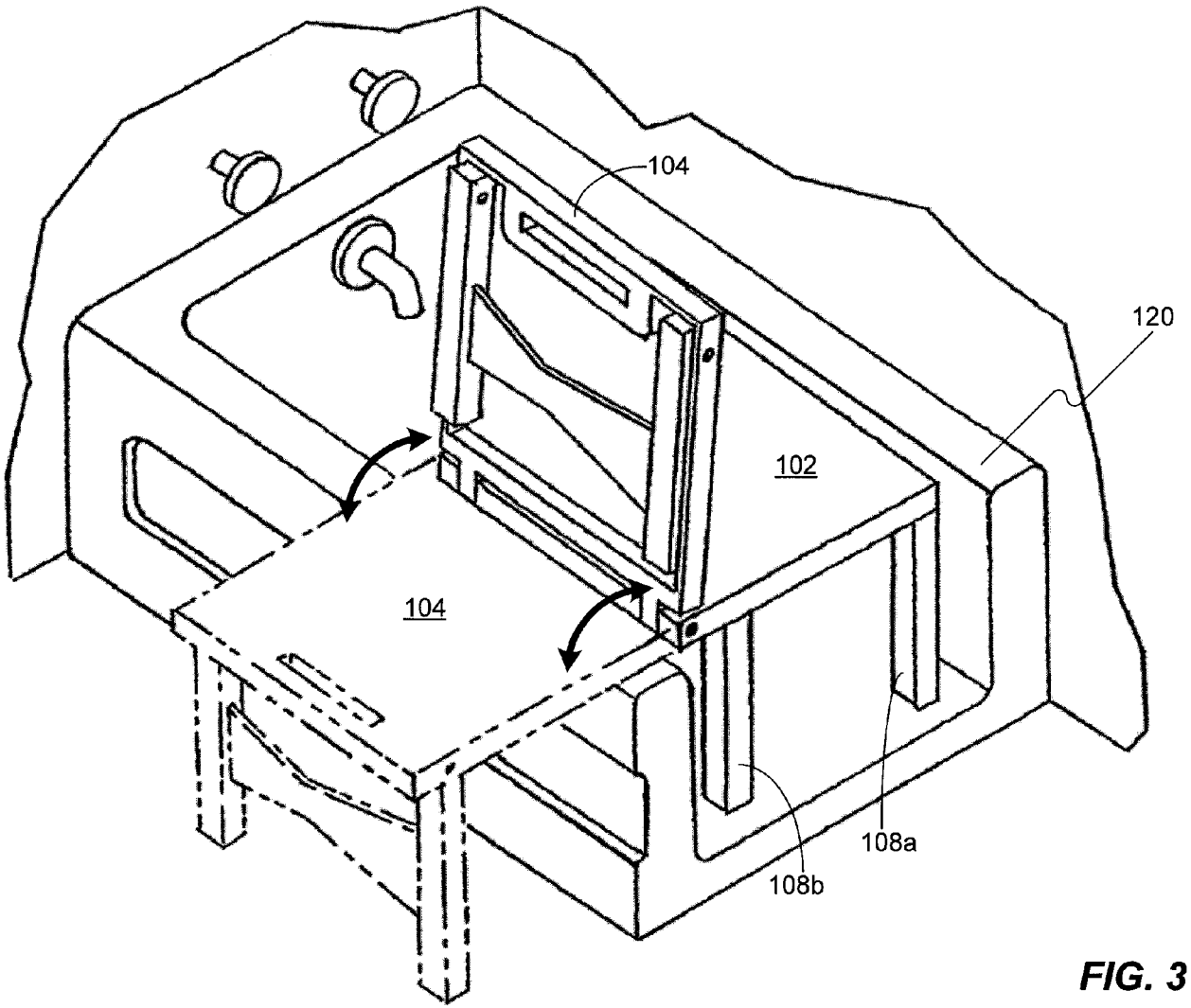
FIG. 3 is a diagram illustrating the positioning of a transfer tub bench within a bathtub, according to one aspect of the present invention.
Figure 4:
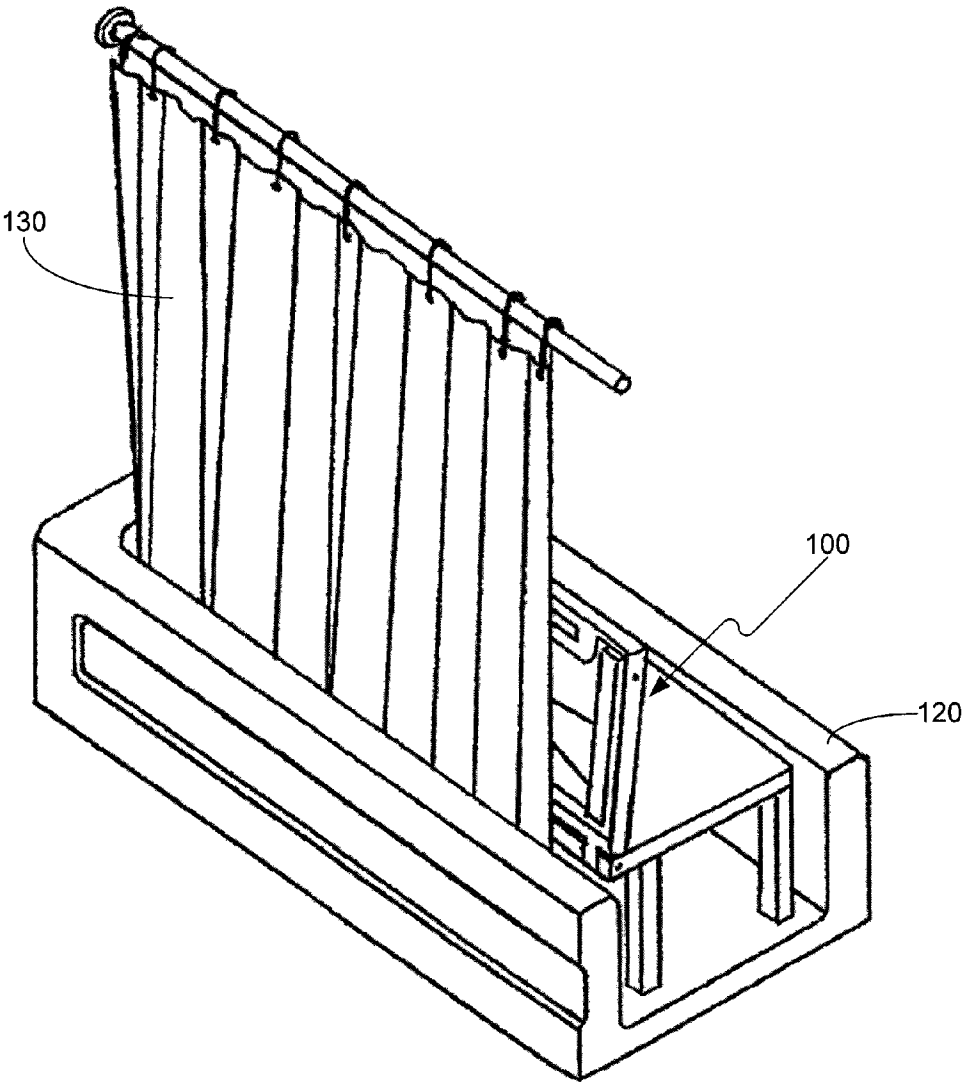
FIG. 4 is a diagram illustrating the positioning of a shower curtain proximate a bathtub having a transfer tub bench disposed therein, according to one aspect of the present invention.

According to various aspects of the present invention, a transfer bench is disclosed for use in an enclosure having a base and a periphery of a predetermined height. In some aspects, the enclosure may be a wet/dry environment, such as a bathtub, shower enclosure (such as a shower stall or shower closet), hot tub, pool, and the like. Optionally, the transfer bench can be used in any suitable environment. Thus, although use of a transfer device is illustrated in FIGS. 3 and 4 in association with a bathtub, it will be apparent to those of ordinary skill in the art that a transfer bench can be used in association with any environment to provide, at least, the disclosed functions. It will be further appreciated that a "person" or "user" of a transfer bench as used herein is intended to encompass the direct user of the transfer bench and/or a designated assistant, such as a nurse, aide, helper, or other care-giver.

The periphery of the enclosure, in some aspects, may have a negligible predetermined height or a predetermined height of zero. For instance, many locker rooms and similar bathing environments have shower stalls with a base that is approximately level with the surrounding floor. Thus, in such shower stalls, at least a portion of the periphery may have a height of zero. In a traditional bathtub, the periphery may have a height of several inches to several feet. In various aspects, the height of the periphery may vary along the length of the periphery. In further aspects, the periphery may defined by a wall (such as in a bathtub), a lip, a shower curtain, a door (such as a door that swings open or slides along a track), other enclosing means, or any combination of these.

Figure 1:
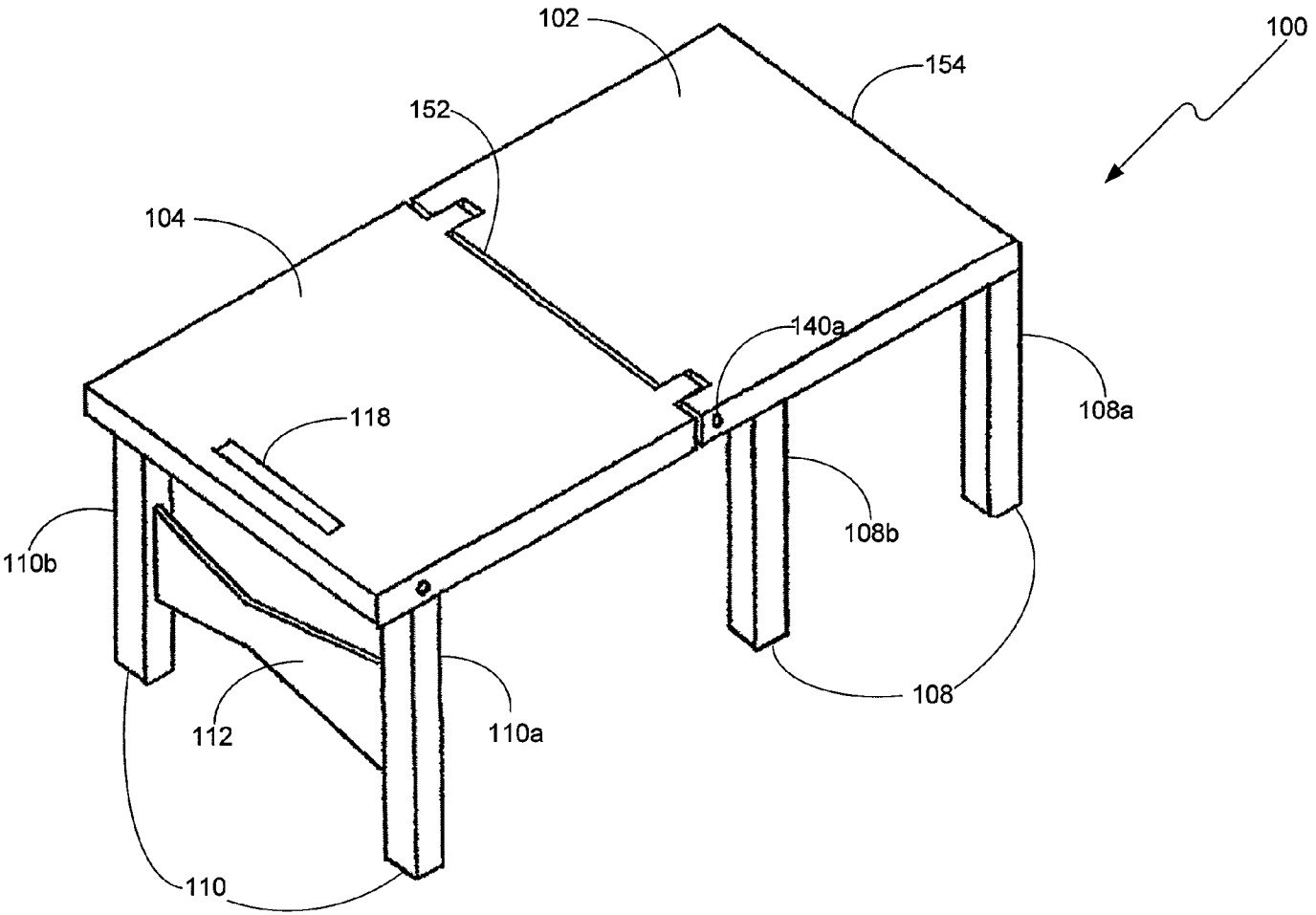
FIG. 1 is a schematic diagram of a perspective view of a transfer tub bench, according to one aspect of the present invention.

A transfer bench, according to one aspect of the present invention, comprises a first seating section and a second seating section that is coupled to the first seating section. With reference to FIG. 1, a transfer bench 100 can comprise a first seating section 102, at least a portion of which substantially lies in a substantially horizontal plane. In one aspect, the first seating section can be substantially planar. Optionally, the first seating section can be shaped to receive at least a portion of a person's posterior. The second seating section 104 can likewise be substantially planar or can be shaped to receive at least a portion of the person's posterior.

In a particular aspect, the second seating section 104 can be coupled or attached to the first seating section 102 in a rotatable manner and can be positioned from and between a first position and a second position. As illustrated in FIG. 3, in one aspect, the first position is a generally horizontal position in which the second seating section is substantially coplanar with the first seating section. The second position can be a generally upright or vertical position in which the second seating section is generally perpendicular to the first seating section. As described herein, a generally horizontal position can refer to a position that is sufficiently horizontal to prevent a user from slipping or sliding off of the first and/or second seating section when in use. A generally vertical position of the second seating section can include a vertical, nearly vertical, or inclined past vertical position, in relation to the position of the first seating section.

The two seating sections can be coupled by various means that allow this movement. For example, the second seating section can be hingedly attached to the first seating section such as by one or more hinges 140. Optionally, the seating sections can be coupled by a pin and hole configuration, a pin and slot configuration, a detent and hole configuration, or any other manner that allows for relative rotational movement of the second seating section. Means 180 can also be provided for selectively maintaining the second seating section in the second position, such as latching or other securing means. Either or both of the first and second seating sections can also comprise water drainage means to drain water from the respective surfaces when the transfer bench is used in a wet environment. Such water drainage means can include holes (such as the exemplary water drainage holes represented by black box 170 shown in FIG. 5), slots, channels, or a combination thereof, configured and positioned in a manner that facilitates water drainage from the surface of the respective seating section.

Figure 5:
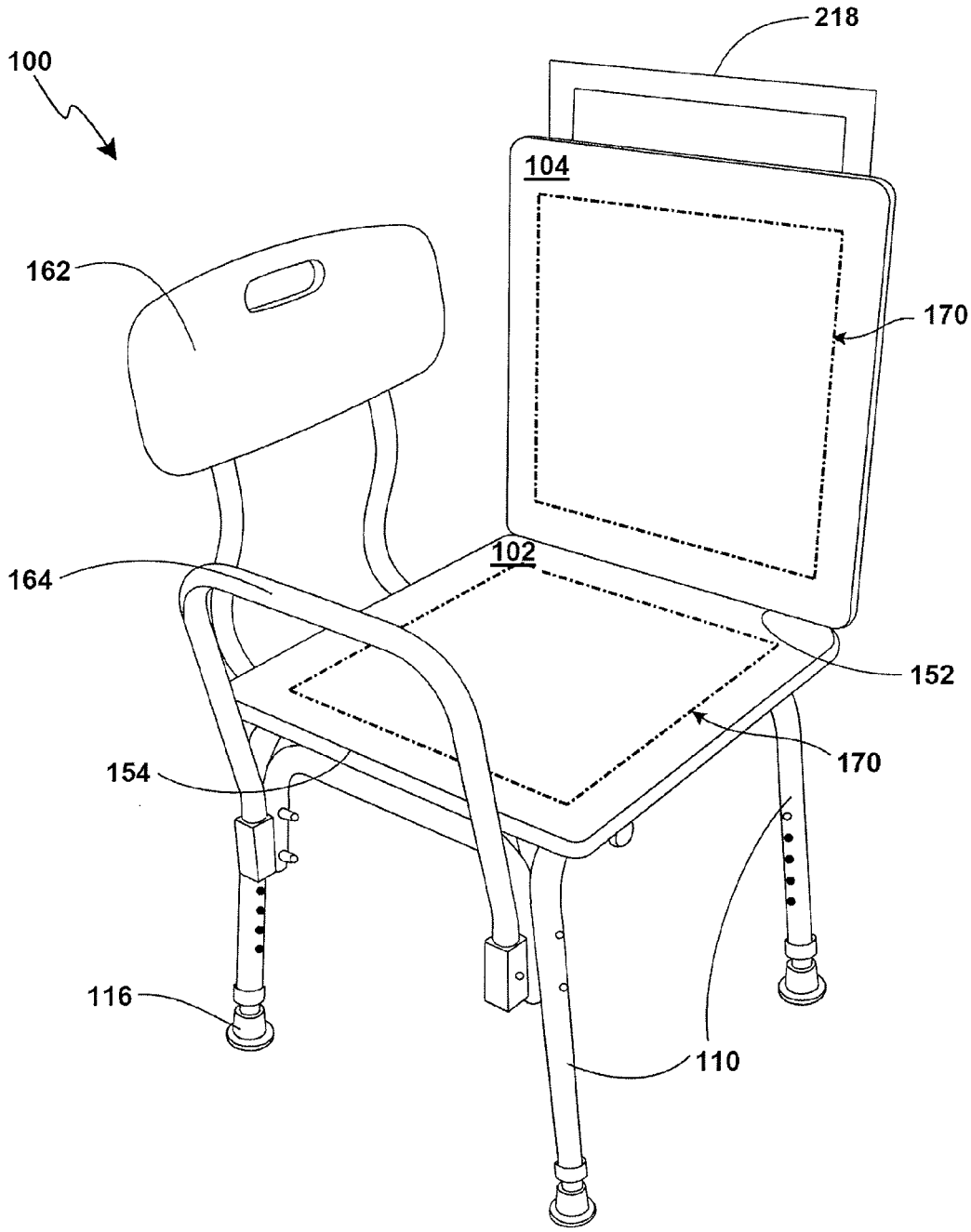
FIG. 5 is a schematic diagram of a perspective view of a transfer tub bench, according to another aspect of the present invention.

In one aspect, the second seating section can comprise a handhold, such as for assisting in stabilizing the user, providing the user with means to move the second seating section from the first position to the second position, or for other purposes. The handhold can be a handle 218 such as shown in FIG. 5, an aperture 118 that extends through the second seating section, such as shown in FIG. 1, or other means. Additional means can be provided for assisting the user in rotating the second seating section to and between the first and second positions, such as a pull cord or other means disposed within, upon, or attached to the second seating section. In one aspect, the latching means, such as described above, can be operatively connected to a handhold or other handling means disposed on or within the second seating section. For example, the handhold can comprise a squeezable mechanism positioned within an aperture extending through the second seating section. A user can grab the handhold to manipulate the second seating section into a vertical position, and the latching mechanism can engage to maintain the second seating section in this position. When the user desires to rotate the second seating section to the horizontal position, the user can squeeze the squeezing mechanism of the handhold to disengage the latching mechanism.

In one aspect, other means can be provided to support a user, such as one or more arm rests 164 or a back support 162 such as shown in FIG. 5, etc. The second seating section when in the vertical position can also support the user, such as by limiting lateral movement of the user or providing a support against which the user can lean or rest. In a particular aspect, such as shown in FIGS. 1 and 5, the first seating section 102 can comprise a first edge 152 and an opposing edge 154. The second seating section 104 can be rotatably coupled to the first seating section proximate the first edge, and an arm rest can be positioned proximate the second edge. In yet another aspect, the transfer bench can comprise a back support 162. The back support can extend from the first seating section at a selected angle. For example, the back support can extend substantially vertically upward from the first seating section. Optionally, the back support can extend at an angle selected at or between horizontal and vertical to allow the user to lie back against the back support. In yet another aspect, the back support can have means for adjusting the angle relative to the first seating section to allow the user to position the back support means to any angle. In some aspects, one or more arm rests and a back support can be provided. Thus, the transfer bench can comprise arm rest(s), a back support, or both. In any aspect in which an arm rest and/or back support is provided, the arm rest(s) and/or back support can be removably attached to the transfer bench. Means can also be provided for attaching the back support proximate one or more edges of the first seating section so that the transfer bench can be used in various enclosures. Optionally, the arm rest(s) and/or back support can be fixedly attached to the transfer bench.

The first and second seating sections are shown as substantially rectangular in FIG. 1 for illustrative purposes only; it is contemplated that each of the seating sections can be of any size and shape to receive and support a user. In one aspect, the second seating section can be sized and shaped such that when the transfer bench is positioned in an enclosure, the second seating section is configured to extend beyond the periphery of the enclosure when in the first position. One or both of the seating sections can comprise a material configured to support the weight of a user and allow the lateral movement (such as sliding movement) of the user across the first and/or second seating sections. Such material can be high-strength plastic, metal, wood, wood composites, aluminum, fiberglass, combinations thereof, or other materials suitable for use.

In a further aspect, a plurality of support means is provided to support each of the first and second seating sections. The support means, in one aspect, are at least as tall as the predetermined height of the periphery of the enclosure. For example, as shown in FIG. 1, at least one first leg 108 can be provided to support the first seating section 102 and at least one second leg 110 can be provided to support the second seating section 104. In a particular aspect, at least four legs can be provided to support the first seating section and at least two legs can be provided to support the second seating section, although other arrangements are contemplated within the scope of the present invention. For example, the first seating section can be supported by more or fewer than four legs and the second seating section can be supported by more or fewer than two legs.

In the particular aspect in which the first seating section is supported by four legs and the second seating section is supported by two legs, when the second seating section is in a generally horizontal position and is substantially coplanar with the first seating section, the transfer bench will be supported by at least six legs. When the second seating section is in a generally vertical position or between the generally horizontal and generally vertical positions, the transfer bench will be supported by the at least four legs supporting the first seating section. In any aspect, each leg can have rubber, soft plastic, suction cup, or other material or means disposed at a foot or distal end of the leg to absorb shock, stabilize the leg, and/or protect the finish of the surface on which the transfer bench is supported. Additional stability can be provided through stiffening members attached or mounted between two or more legs. For example, as shown in FIG. 1, a stiffening member 112 can be provided between legs 110 that support the second seating section 104. Stiffening members or other support or stiffening means likewise can be provided between legs 108 that support the first seating section 102.

Figure 2:
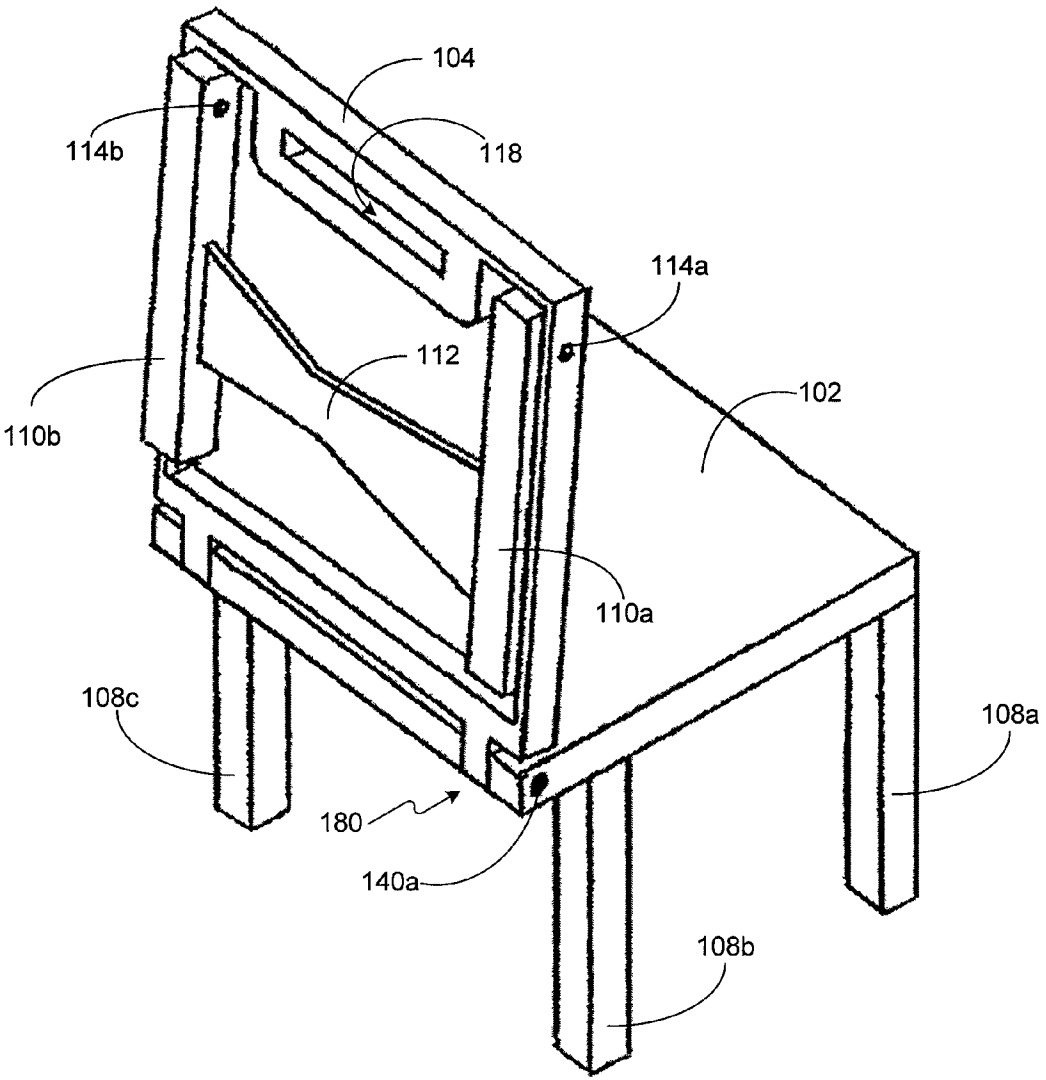
FIG. 2 is a schematic diagram of a perspective view of a transfer tub bench, according to yet another aspect of the present invention.

According to various aspects, each leg can have a selectively adjustable height such that it can be extended and retracted. For example, each leg can be telescoping, pads on the feet or distal ends of the legs can be adjusted to various lengths (e.g., as by screw-type rotation), or each leg can be secured at various lengths through the use of a cotter-pin or other pin or detent-type assembly. In a particular embodiment, each leg can be individually adjustable. The transfer bench can thus be used in environments with uneven, sloped, or staggered-height surfaces and the first seating section can be maintained in a generally horizontal position to provide increased safety to the user. Likewise, when the second seating section is in the first position, it can lie in a substantially coplanar and horizontal orientation with relation to the first seating section. It is contemplated that the transfer bench can have legs that are of a height that is at least as tall as the predetermined height of the periphery. In various aspects, one or more legs can be rotatably coupled to the first and/or second seating section. For example, in a particular aspect, the leg(s) 110 supporting the second seating section 104 can be rotatably or hingedly coupled to the second seating section. As shown in FIG. 2, when the second seating section is rotated to a generally vertical position, the legs 110*a*, 110*b* can rotate to collapse or lie flat against the bottom surface of the second seating section. Other configurations for attaching the legs 110 to the second seating section, as well as means for folding the legs, such as but not limited to a spring loaded design, sideways folding mechanism, etc., are contemplated and are considered to be within the scope of the present invention.

In use, methods are disclosed for facilitating movement of a person into and out of an enclosure. The method comprises providing a transfer bench, such as described above according to various aspects. For example, with reference to FIG. 3, a transfer bench can be provided that comprises a first seating section 102 supported by one or more legs 108 and a second seating section 104 rotatably coupled to the first seating section, and also supported by one or more respective legs 110. The method comprises positioning the transfer bench within an enclosure having a base and a periphery of a predetermined height such as, but not limited to, a bathtub 120. In a particular aspect, the transfer bench is selectively positioned within the enclosure such that at least the first seating section is fully disposed within the periphery.

The second seating section can be configured to rotate from and between a first, generally horizontal, position and a second, generally vertical position. The method can further comprise positioning the second seating section to the first position, such that at least a portion of the second seating section extends beyond the periphery of the enclosure. For example, FIG. 3 illustrates a transfer bench in use in a standard bathtub. The transfer bench is placed in the bathtub such that the first seating section is entirely disposed within the periphery of the bathtub. The second seating section, when positioned in a generally horizontal position, extends beyond the periphery of the bathtub. In this position, the legs supporting the second seating section can be configured to extend downwardly to support the second seating section.

Legs supporting the first and second seating sections can be individually and selectively adjustable in height. The legs 108 supporting the first seating section can be manipulated to adjust the height of the first seating section, such that the legs are at least as tall as the predetermined height of the periphery. For example, in use in a bathtub, the legs can be adjusted to position the first seating section at a height that is at least as high as the wall of the bathtub, such that the second seating section can extend across the periphery without obstruction when in the first position. The legs can be adjusted, for example, if the base of the enclosure is uneven, sloped, etc., so that the first seating section can be maintained in a generally horizontal plane. The leg(s) supporting the second seating section can also be selectively adjusted. For example, if the floor surface outside of the enclosure is at a different level than the height of the base of the enclosure, the legs can be extended or retracted to maintain the first and second seating section in a substantially horizontal and coplanar arrangement when the second seating section is in the first position.

The method can further comprise receiving the person on the second seating section. The person can then be transferred to the first seating section. For example, a user of the transfer bench can sit on the second seating section and move to the first seating section by lifting each of the user's legs over the periphery of the enclosure (such as but not limited to a bathtub wall) and sliding or shifting toward the first seating section.

The method can further comprise rotating the second seating section from the first position to the second position, such as indicated by the arrows in FIG. 3. A handhold or other means can be provided to assist the person, or someone assisting the person in using the transfer bench, in rotating the second seating section. In a specific aspect, it is contemplated that when the second seating section is in the generally vertical position, the transfer bench is substantially disposed within the periphery of the enclosure. In this position, a shower door, shower curtain, or other enclosure means can be drawn or extended to enclose the transfer bench within the enclosure. The legs supporting the second seating section can be rotatably coupled to the second seating section and configured to collapse or lie substantially flat against a bottom surface of the second seating section when in the generally vertical position.

Latching or securing means can be provided and/or manipulated to maintain the second seating section in the generally vertical position. Enclosure means can then be manipulated to at least partially enclose the enclosure, such as shown in FIG. 4. For example, a shower curtain 130, door, or other enclosure means can be pulled or drawn to enclose the enclosure. In a wet environment, enclosure means can be manipulated to enclose the enclosure and prevent water from spilling beyond the periphery of the enclosure. The person can then bathe, shower, etc. in a safely supported and seated position within the enclosure; the person can also utilize the upright second seating section as additional stabilizing means. As described above, a back support, arm rest, or both, can be provided to further support and/or stabilize the person.

To exit the enclosure, the person can manipulate the enclosure means to a position that allows the second seating section to be extended to a generally horizontal position. The second seating section can be rotated to this position and the person can move from the first seating section to the second seating section in a reverse manner than that described above.

It will be apparent to those skilled in the art that various modifications and variations can be made in the present invention without departing from the scope or spirit of the invention. Other aspects of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A transfer bench configured for use in an enclosure having a base and a periphery of a predetermined height, said transfer bench consisting of:

a first seating section, wherein at least a portion of said first seating section lies substantially in a horizontal plane;

second seating section rotatably coupled to said first seating section and configured to rotate from and between a first position, in which said second seating section is generally coplanar to said first seating section, to a second position, in which said second seating section is positioned substantially perpendicular relative to said first seating section, wherein the second seating section cannot rotate more than about 90 degrees from the first position;

a plurality of legs comprising at least a first leg configured to support said first seating section on a portion of said base of said enclosure and at least a second leg configured to support said second seating section in said first position on a portion of a surface exterior to said enclosure;

a means for selectively maintaining said second seating section in said second position, wherein in said second position, said first seating section, said second seating section, and said plurality of legs are substantially positioned within said periphery of said enclosure; and a non-rotatable back support member extending from said first seating section at a selected angle, the back support member extending from a side of the first seating section perpendicular to an axis of rotation of the second seating section.

2. The transfer bench of claim 1, wherein said second seating section comprises a bottom surface and wherein said second leg is rotatably coupled to said second seating section and configured to substantially lie flat against said bottom surface when said second seating section is in said second position, and wherein an axis of rotation of the second leg is parallel to an axis of rotation of the second seating section.

3. The transfer bench of claim 1, wherein said plurality of legs are at least as tall as said predetermined height.

4. The transfer bench of claim 1, wherein a height of each of said plurality of legs is individually adjustable.

5. The transfer bench of claim 1, wherein said second seating section comprises at least one handhold.

6. The transfer bench of claim 1, wherein said first seating section comprises at least a first edge and an opposing second edge, wherein said second seating section is rotatably coupled to said first seating section proximate said first edge, said transfer bench further comprising an arm rest positioned proximate said second edge.

7. The transfer bench of claim 1, wherein each of said first seating section and said second seating section comprises a material configured to support the weight of a user.

8. The transfer bench of claim 1, wherein at least a portion of said first seating section comprises means for draining water from a surface of said first seating section.

9. A method of facilitating movement of a person into and out of an enclosure having a base and a periphery of a predetermined height, said method comprising:

providing a transfer bench consisting of:

a first seating section, wherein at least a portion of said first seating section lies substantially in a horizontal plane;

a second seating section rotatably coupled to said first seating section and configured to be rotated from and between a first position, in which said second seating section is generally coplanar to said first seating section, and a second position, in which said second seating section is positioned substantially perpendicular relative to said first seating section, wherein the second seating section cannot rotate more than about 90 degrees from the first position;

a plurality of legs comprising at least a first leg configured to support said first seating section on a portion of said base of said enclosure, and at least a second leg configured to support said second seating section in said first position on a portion of a surface exterior to said enclosure;

means for selectively maintaining said second seating section in said second position;

a means for selectively maintaining said second seating section in said second position; and a non-rotatable back support member extending from said first seating section at a selected angle, the back support member extending from a side of the first seating section perpendicular to an axis of rotation of the second seating section; and selectively positioning said transfer bench in said enclosure, wherein at least said first seating section and said first leg of said plurality of legs are fully disposed within said periphery of said enclosure.

10. The method of claim 9, further comprising positioning said second seating section in said first position, wherein in said first position at least a portion of said second seating section is configured to extend beyond said periphery of said enclosure.

11. The method of claim 10, further comprising receiving said person on said second seating section and transferring said person to said first seating section.

12. The method of claim 11, further comprising rotating said second seating section from said first position to said second position, wherein said transfer bench is substantially disposed within said periphery when said second seating section is in said second position.

13. The method of claim 12, further comprising selectively enclosing said enclosure proximate at least a portion of said periphery.

14. The method of claim 9, wherein at least a height of said first leg is selectively adjustable, said method further comprising adjusting said first leg to a height that is at least as tall as said predetermined height of said periphery.

15. A transfer bench configured for use in an enclosure having a base and a periphery of a predetermined height, said transfer bench consisting of:

a first seating section, wherein at least a portion of said first seating section lies substantially in a horizontal plane and is configured to receive a user;

a second seating section rotatably coupled to said first seating section and configured to rotate from and between a first position, in which said second seating section is generally coplanar to said first seating section, to a second position, in which said second seating section is positioned substantially perpendicular relative to said first seating section, wherein the second seating section cannot rotate more than about 90 degrees from the first position;

a plurality of legs comprising at least a first leg configured to support said first seating section on a portion of said base of said enclosure and at least a second leg configured to support said second seating section in said first position on a portion of a surface exterior to said enclosure;

means for selectively maintaining said second seating section in said second position, wherein in said second position, said first seating section, said section seating section, and said plurality of legs are substantially positioned within said periphery of said enclosure, and wherein in said second position, said second seating section is configured to stabilize said user; and a non-rotatable back support member extending from said first seating section at a selected angle, the back support member extending from a side of the first seating section perpendicular to an axis of rotation of the second seating section.

16. The transfer bench of claim 15, wherein said second seating section comprises a bottom surface and wherein said second leg is rotatably coupled to said second seating section and configured to substantially lie flat against said bottom surface when said second seating section is in said second position, and wherein an axis of rotation of the second leg is parallel to an axis of rotation of the second seating section.

17. The transfer bench of claim 15, wherein said first seating section comprises at least a first edge and an opposing second edge, wherein said second seating section is rotatably coupled to said first seating section proximate said first edge, said transfer bench further comprising an arm rest positioned proximate said second edge.

18. The transfer bench of claim 15, wherein at least a portion of said first seating section comprises means for draining water from a surface of said first seating section.

* * * * *